US010725417B2

(12) United States Patent
Saito

(10) Patent No.: US 10,725,417 B2
(45) **Date of Patent: *Jul. 28, 2020**

(54) IMAGE PROCESSING SYSTEM

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Yuichi Saito, Numazu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/519,042

(22) Filed: Jul. 23, 2019

(65) Prior Publication Data

US 2019/0346802 A1 Nov. 14, 2019

Related U.S. Application Data

(63) Continuation of application No. 15/455,441, filed on Mar. 10, 2017, now Pat. No. 10,372,075.

(30) Foreign Application Priority Data

Jul. 20, 2016 (JP) ..... 2016-142640

(51) Int. Cl.

| | |
|---|---|
| ***G03G 15/00*** | (2006.01) |
| ***B65H 31/24*** | (2006.01) |
| ***G03G 15/01*** | (2006.01) |

(52) U.S. Cl.

CPC ..... *G03G 15/6541* (2013.01); *B65H 31/24* (2013.01); *G03G 15/01* (2013.01);
(Continued)

(58) Field of Classification Search

CPC ..... G03G 15/6541; G03G 15/6538; G03G 15/6582; G03G 15/01; B65H 31/24; B65H 2405/332

See application file for complete search history.

(56) References Cited

U.S. PATENT DOCUMENTS 8,538,317 B2 9/2013 Iguchi
8,743,164 B2 6/2014 Iguchi et al.
(Continued)

FOREIGN PATENT DOCUMENTS

JP 2014-10239 1/2014

OTHER PUBLICATIONS

Non-Final Office Action for U.S. Appl. No. 15/455,441 dated Sep. 14, 2018.

*Primary Examiner* — David H Banh

(74) *Attorney, Agent, or Firm* — Amin, Turocy & Watson, LLP

(57) ABSTRACT

In accordance with an embodiment, an image processing system comprises a discharge section, a first tray, a second tray, and a controller. The discharge section discharges a processed sheet. The first tray and the second tray vertically move to load the sheet discharged from the discharge section. The controller drives either one or both of the first tray and the second tray to carry out control to discharge a sheet to which an image forming processing is executed to one of the first tray and the second tray and carries out control to discharge a sheet to which a decoloring processing is executed to the other tray according to a type of a job received by a reception section.

20 Claims, 7 Drawing Sheets

(52) U.S. Cl.
CPC ..... *G03G 15/6538* (2013.01); *G03G 15/6582* (2013.01); *B65H 2405/332* (2013.01)

(56) References Cited

U.S. PATENT DOCUMENTS

| | | | | |
|---|---|---|---|---|
| 10,372,075 | B2 * | 8/2019 | Saito | G03G 15/6541 |
| 2010/0097421 | A1 | 4/2010 | Yoshida et al. | |
| 2011/0211033 | A1 | 9/2011 | Yahata et al. | |
| 2013/0032992 | A1 | 2/2013 | Sato et al. | |
| 2014/0176999 | A1 | 6/2014 | Umezawa | |
| 2014/0255056 | A1 * | 9/2014 | Katayama | G03G 15/6585 399/85 |
| 2016/0070997 | A1 * | 3/2016 | Takahashi | H04N 1/00801 358/3.24 |
| 2017/0072729 | A1 * | 3/2017 | Arima | G03G 15/5062 |

* cited by examiner

IMAGE PROCESSING SYSTEM

CROSS-REFERENCE TO RELATED APPLICATIONS

This application is a Continuation of application Ser. No. 15/455,441 filed on Mar. 10, 2017, the entire contents of which are incorporated herein by reference.

This application is based upon and claims the benefit of priority from Japanese Patent Application No. 2016-142640, filed Jul. 20, 2016, the entire contents of which are incorporated herein by reference.

FIELD

Embodiments described herein relate generally to an image processing system having both a function of forming an image on a sheet and a function of decoloring a formed image on the sheet.

BACKGROUND

There is an image processing apparatus which has both a function of forming an image on a sheet and a function of heating the image formed with a decoloring color material to decolorize the image.

The image processing apparatus heats and pressurizes an image formed on the sheet with a decoloring color material or a non-decoloring color material with a heating device to fix the image on the sheet. The image processing apparatus heats the sheet on which the image is formed with the decoloring color material with the heating device to a decoloring temperature higher than a fixing temperature to erase the image.

The image processing apparatus can be connected with a post-processing device having a post-processing function for executing a conventional act such as alignment, sorting, staple binding, punching processing, and center folding processing to the sheet to which an image forming processing or a decoloring processing is executed in addition to the above.

DETAILED DESCRIPTION

Figure 1:
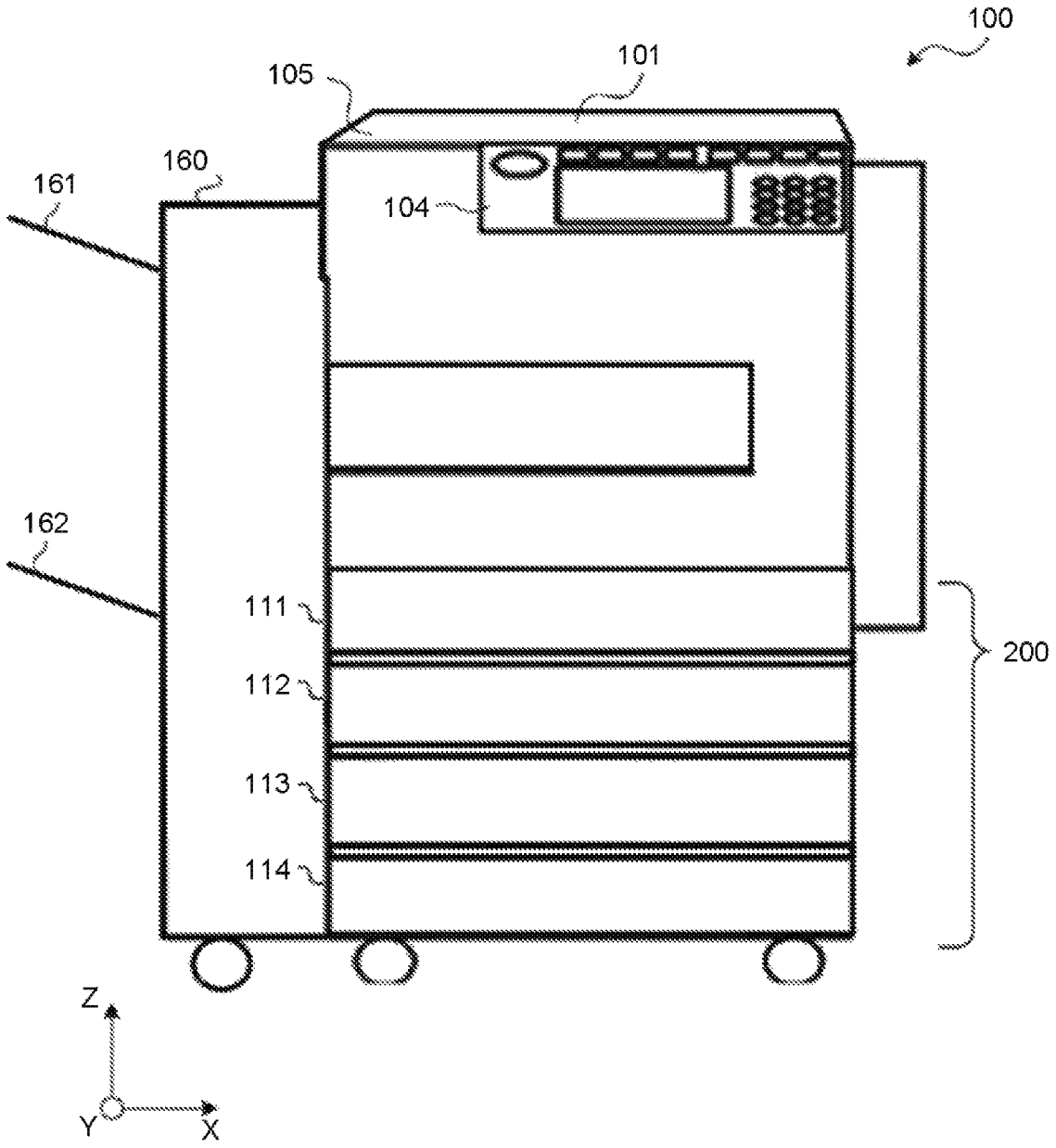
FIG. 1 is an external view illustrating an image processing system according to an embodiment.

In accordance with an embodiment, an image processing system comprises a discharge section, a first movable tray, a second movable tray, and a controller. The discharge section discharges a sheet processed by a processing section. The first movable tray vertically moves to load the sheet discharged from the discharge section. The second movable tray is arranged below the first movable tray, and vertically moves to load the sheet discharged from the discharge section. The controller drives either one or both of the first movable tray and the second movable tray to carry out control to discharge a sheet to which an image forming processing is executed to one of the first movable tray and the second movable tray and carries out control to discharge a sheet to which a decoloring processing is executed to the other movable tray according to a type of a job received by a reception section.

An image processing system according to the embodiment includes an image processing apparatus and a post-processing device. The image processing apparatus has both a function of forming an image on a sheet and a function of decolorizing the image formed on the sheet with a decoloring color material. The post-processing device executes a post-processing to a sheet to which the image forming processing by the image processing apparatus is executed or a sheet to which the decoloring processing is executed. The post-processing in the present embodiment refers to one or a plurality of the following processing.

- an alignment processing for stacking a plurality of sheets on a processing tray to gather the sheets to align them.
- a staple processing for executing a binding processing with a stapler to a sheet bundle after alignment.
- a punching process for executing a processing of punching a hole on a sheet.
- a center folding processing for folding a center part of the plurality of the sheets in half.
- a sorting processing for shifting the sheet in a conveyance direction or a sheet width direction orthogonal to the conveyance direction to discharge the sheet to the tray.

The post-processing device of the embodiment has a plurality of movable trays. The movable tray can move the sheet after the post-processing from the image processing apparatus to a discharge port (discharge section) for discharging. The post-processing device discharges the sheet to which the image forming processing is executed and the sheet to which the decoloring processing is executed to difference movable trays according to a type of a job. Thus, it is possible to suppress mixing of the sheet to which the image forming processing is executed and the sheet to which the decoloring processing is executed and it is not necessary to executing a sorting job by hand.

The image processing apparatus of the embodiment can carry out both a printing with a decoloring color material and a printing with non-decoloring color material. The decoloring color material is fixed on the sheet if heated to a prescribed fixing temperature or higher, and is decolored if heated to a prescribed decoloring temperature higher than the fixing temperature. The decoloring color material includes a color developing compound, a color developing agent and a decoloring agent. For example, leuco dyes are exemplified as the color developing compound. Phenols are exemplified as the color developing agent. A matter which is blended with the color developing compound if heated and has no affinity to the color developing agent is exemplified as the decoloring agent. The decolorable color material develops color through interaction between the color developing compound and the color developing agent and is decolored as the interaction between the color developing compound and the color developing agent is cut off by the heating at a temperature higher than or equal to the decoloring temperature.

Further, in the embodiment, toner is exemplified as the color material; however, the form of the embodiment is also applied to a case of executing an image forming processing with ink. The "decoloring" in the embodiment refers to making an image formed with a color (containing not only chromatic colors but also achromatic colors such as white, black and the like) different from a base color of the sheet invisible visually. The "invisible visually" refers to making the image formed with the color different from the base color of the sheet change to a color identical or similar to the base color of the sheet in addition to a form in which the image formed with the color different from the base color of the sheet is colorless (transparent).

Figure 2:
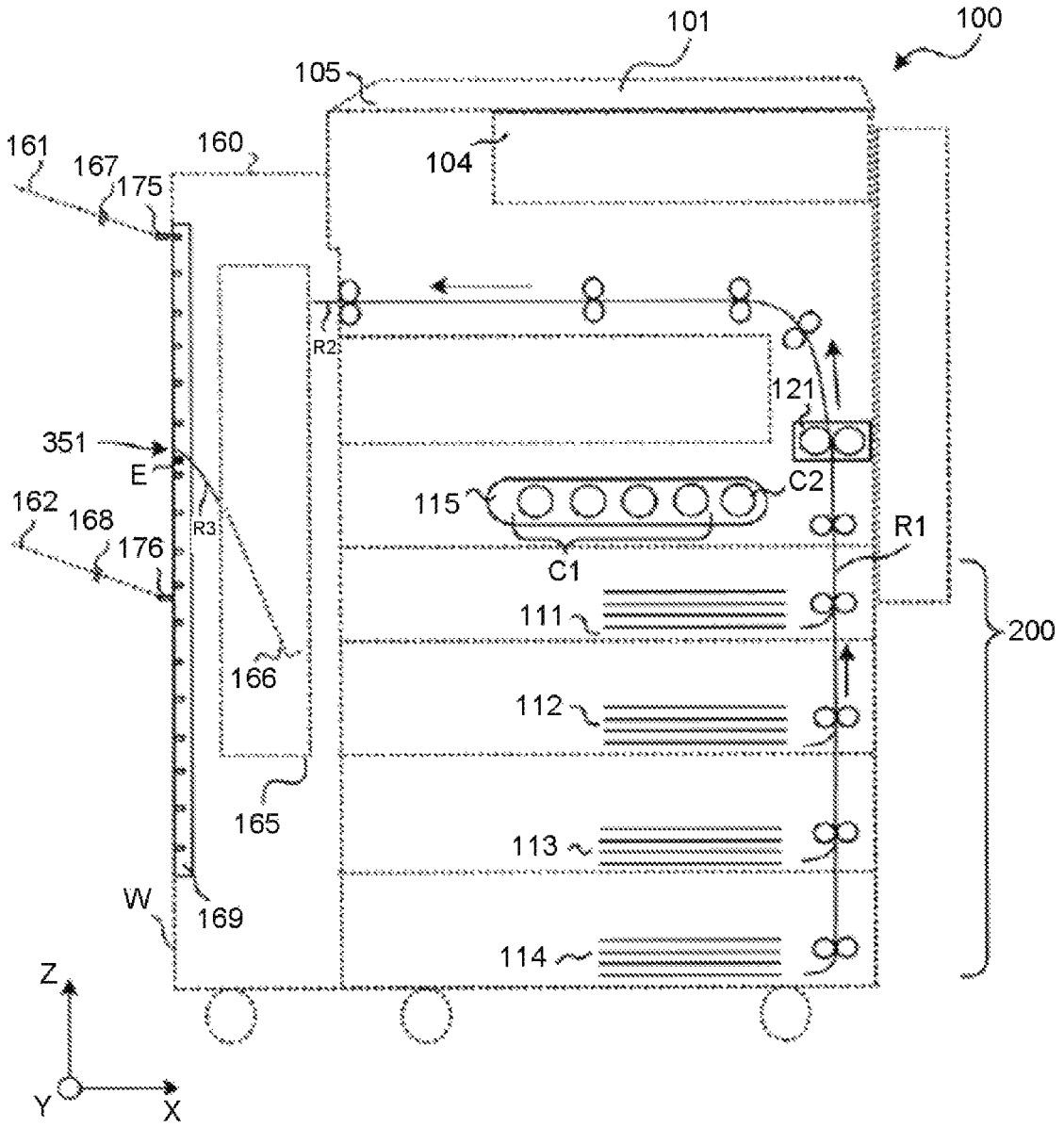
FIG. 2 is a pattern diagram exemplifying the internal constitution of the image processing system according to the embodiment.

FIG. 1 is a diagram illustrating the exterior of an image processing system according to the embodiment, and FIG. 2 is a pattern diagram exemplifying the internal constitution of the image processing system. Further, X axis, Y axis and Z axis in each figure are common. An arrow in FIG. 2 indicates a conveyance direction of a sheet. The constitution of an image processing apparatus system 100 is described below with reference to FIG. 2.

The image processing system 100 of the embodiment includes an image processing apparatus 101 and a post-processing device 160.

The image processing apparatus 101 has cassettes 111, 112, 113 and 114 for housing the sheet and supplying the sheet at the time of executing a job. The cassettes 111, 113 and 114 respectively house unused new sheets with different sizes. The cassette 112 houses a sheet to which an image formation is executed with the decoloring color material after used. In other words, a sheet that is reusable by erasing an image through executing a decoloring processing although the image is currently formed on a sheet surface is housed in the cassette 112. The decoloring processing in the present embodiment refers to a processing of heating the sheet on which an image is formed with the decoloring color material to a prescribed decoloring temperature or higher that is higher than a fixing temperature.

Hereinafter, the cassettes 111, 113 and 114 are called normal cassettes, and the cassette 112 is called a used cassette. The cassettes 111 to 114 can be referred to as a sheet feed section 200.

The image processing apparatus 101 has an image forming section 115 for forming an image on the sheet. The image forming section 115 can execute both a printing with a decoloring color material and a printing with a non-decoloring color material. The image forming section 115 has a cartridge C1 for housing the non-decoloring color material which is the normal color material and a cartridge C2 for housing a decoloring color material which is decolorized at the prescribed decoloring temperature or higher. The cartridge C1 is composed of cyan, magenta, yellow, and black cartridges. The image processing apparatus 101 has a heating device 121 for heating and pressurizing the sheet on which the image is formed to fix the image on the sheet. The heating device 121 can generate heat to the decoloring temperature higher than the fixing temperature. The image processing apparatus 101 can heat the sheet fed from the used cassette 112 to the decoloring temperature with the heating device 121 to execute the decoloring processing.

The image processing apparatus 101 includes a conveyance path R1 for conveying the sheet in the order of the sheet feed section 200, an image forming section 115, the heating device 121 and a post-processing device 160 described below. The image processing apparatus 101 has an operation panel 104 for receiving an input of a parameter value such as a printing number and an instruction of starting a processing from a user to display a job process. The image processing apparatus 101 has a scanning section 105 for reading a document sheet arranged on a transparent glass plate. The image read by the scanning section 105 is output to the image forming section 115 and the image forming section 115 forms the image on the sheet (copy processing).

The image processing system 100 has the post-processing device 160 that is optionally mountable. The post-processing device 160 has a conveyance path R2 for continuously conveying the sheet conveyed via the conveyance path R1 in the post-processing device 160. The conveyance path R2 conveys the sheet to the inside of a post-processing section 165. The post-processing section 165 includes alignment plates for gathering an end of the sheet to align the sheet, a stapler for executing a binding processing, a center folding mechanism for executing the center folding processing and a punching mechanism for executing the punching processing. Further, the post-processing section 165 is not necessary to have all those mechanisms, and may have one or a plurality of them. The post-processing section 165 places the conveyed sheet to a processing tray 166 to bundle a plurality of sheets to align them. The post-processing section 165 executes the sorting processing, and any one of the staple processing, the punching processing and the center folding processing to the sheet as necessary. The sheet bundle after the post-processing is discharged to a movable tray 161 or a movable tray 162 via the conveyance path R3.

The movable trays 161 and 162 are capable of moving in a vertical direction (Z axis direction). Any one of the movable trays 161 and 162 moves to a discharging port (discharge section) 351 of the conveyance path R3 to receive the sheet discharged from the discharge port (discharge section) 351. At this time, a sensor E arranged nearby the discharging port (discharge section) 351 detects the uppermost surface of the sheet bundle placed on the movable trays 161 and 162 to execute adjustment of a position so that the sheet is discharged on the uppermost surface of the sheet bundle.

The movable tray 161 has a detection sensor 167 for detecting whether or not there is a sheet on the tray, and the movable tray 162 has a detection sensor 168 for detecting whether or not there is the sheet on the tray. A detection method for detecting whether the sheet is placed on the tray by the detection sensors 167 and 168 may adopt a well-known technology.

The positions of the movable trays 161 and 162 in the vertical direction are detected by a sensor composed of light emission elements 175 and 176 and a light receiving element group 169. The light emission elements 175 and 176 emit light in a horizontal direction towards a housing side wall W of the post-processing device 160. The light receiving element group 169 is constituted by a plurality of light receiving elements arranged in the vertical direction along a housing inner wall W of the post-processing device 160. The light emitted from light emission elements 175 and 176 is received by any element of the light receiving element group 169 to be capable of specifying the positions of the movable trays 161 and 162 in the vertical direction.

Figure 3:
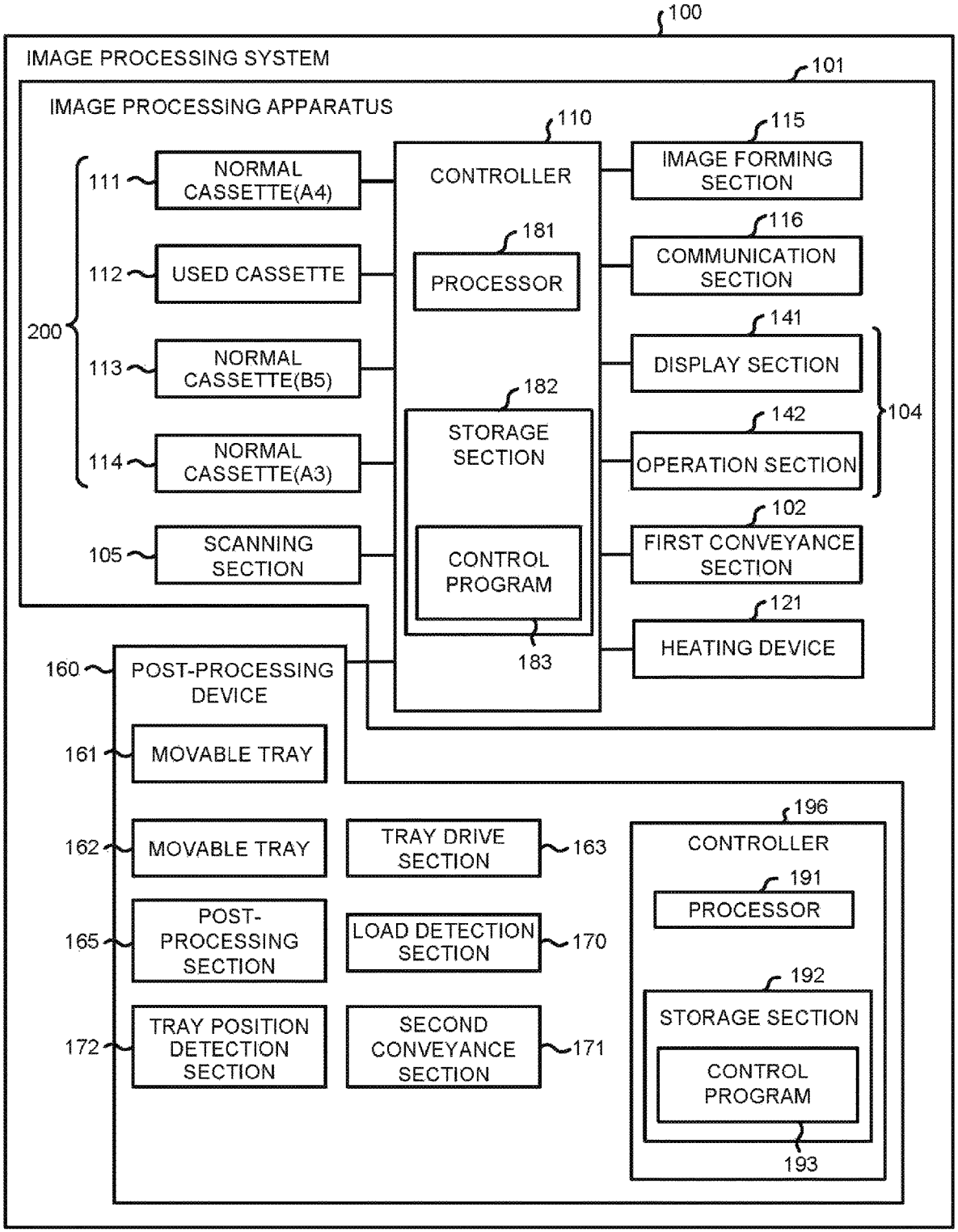
FIG. 3 is a block diagram exemplifying the constitution of the image processing system according to the embodiment.

FIG. 3 is a block diagram exemplifying the constitution of the image forming system 100 including the image processing apparatus 101 and the post-processing device 160. The image processing apparatus 101 includes a controller 110 at least including a processor 181 and a storage section 182. For example, the processor 181 is an arithmetic processing device such as a CPU (Central Processing Unit). The processor 181 executes programs stored in the storage section 182 to perform various functions. The storage section 182 includes a main storage device that stores data in a volatile manner and directly inputs and outputs data from and to the processor 181. Further, the storage section 182 includes a ROM and an auxiliary storage device, and stores a control program 183 and data in a nonvolatile manner. The processor 181 computes and executes the control program 183 stored in the storage section 182 previously, and in this way, the controller 110 collectively controls each units of the image processing apparatus 101. Further, a part or all of the functions provided by the controller 110 may be implemented by a circuit such as an ASIC (application specific integrated circuit).

The image processing apparatus 101 has a communication section 116. The communication 116 receives print data from a personal computer based on an instruction of the controller 110. The communication section 116 sends a message relating to a processing result and a state status to the personal computer. The image processing apparatus 101 forms an image of the print data on the sheet after receiving the print data (printing processing).

The operation panel 104 includes a display section 141 which is a flat type liquid crystal monitor and an operation section 142 composed of physical buttons and a touch panel overlapped on the display section 141. A conveyance section 102 contains the conveyance path R1 to convey the sheet to each unit according to the instruction of the controller 110.

The normal cassettes 111, 113 and 114 and the used cassette 112 shown in FIG. 3 are as stated above; however, sizes of the sheets housed in parentheses are described in FIG. 3. In the present embodiment, the normal cassette 111 houses the sheets with A4 size. The normal cassette 113 houses the sheet with B5 size and the normal cassette 114 houses the sheet with A3 size. Although the sheet with a prescribed size is housed in the used cassette 112, the size herein is not limited in the present embodiment.

The scanner section 105, the image forming section 115 and the heating device 121 are as described above.

A tray drive section 163 of the post-processing device 160 moves the movable trays 161 and 162 separately in the vertical direction. The tray drive section 163 can carry out control to move only the movable tray 161 and stop the movable tray 162 and vice versa. The tray drive section 163 may carry out control to move the movable tray 161 upwards and the movable tray 162 downwards and vice versa.

A load detection section 170 includes detection sensors 167 and 168 to separately detect whether or not there are sheets loaded on the movable trays 161 and 162. A tray position detection section 172 includes the light emission elements 175 and 176 and the light receiving element group 169 to detect positions of the movable trays 161 and 162 in the vertical direction. Detection signals of the load detection section 170 and the tray position detection section 172 are output to the controller 110, and the controller 110 executes a processing based on the signals. The second conveyance section 171 includes the conveyance paths R2 and R3 to convey the sheet to each unit and the movable trays according to an instruction of the controller 110.

The movable trays 161 and 162 and the post-processing section 165 of the post-processing device 160 are as described above. Further, the post-processing device 160 includes a controller 196 at least including a processor 191 and a storage section 192. A control program 193 is stored in the storage section 192. The controller 196 can collectively control each unit (the movable tray 161, the movable tray 162, the post-processing section 165, the tray drive section 163, the load detection section 170, the second conveyance section 171 and the tray position detection section 172) of the post-processing device 160 by computing and executing the control program 193 stored in the storage section 192 by the processor 191 similar to the main body controller 110 of the image processing apparatus 100. The controller 196 functions in a state in which the post-processing device 160 is connected with the image processing apparatus 101. The post-processing device 160 may operate each unit thereof under the control of the controller 196.

Next, a switching control of a discharge destination of the sheet in the embodiment is described. The flowcharts are performed by executing the control program 183 by the processor 181. In the flowcharts shown in the following diagrams, the movable tray 161 is described as a first movable tray, and the movable tray 162 is described as a second movable tray 162.

Figure 4:
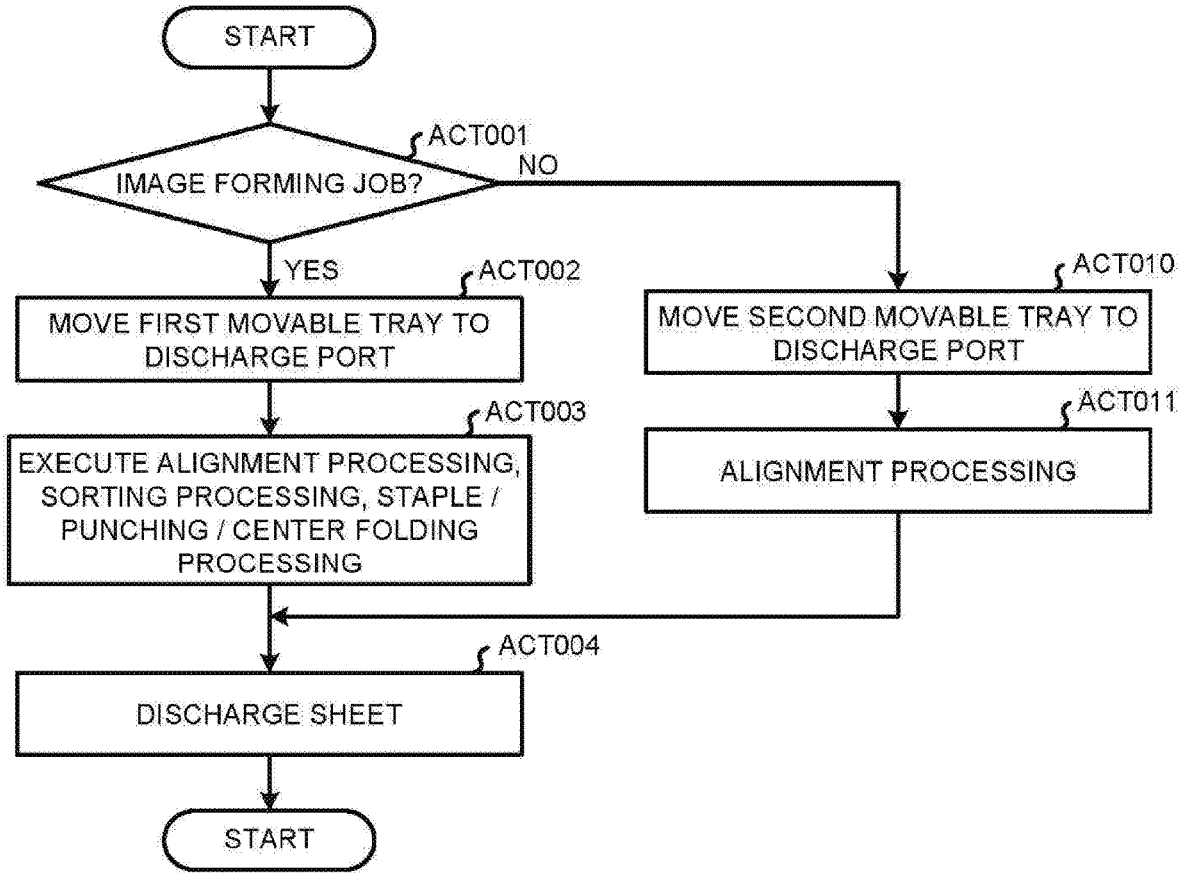
FIG. 4 is a flowchart exemplifying the operation according to the embodiment (discharge destination control according to a job type)

FIG. 4 is a flowchart exemplifying the operation of determining a discharge destination tray according to the type of the job to discharge the sheet to the determined tray. Further, the type of the job in the present embodiment is set to either an image forming job or a decoloring job. The image forming job is a collective term of jobs for forming an image on the sheet such as a copy job, a printing job, a FAX receiving job and the like. The decoloring job is a job for executing the decoloring processing by the heating device 121 to the image formed on the sheet.

The controller 110 determines whether the job which is instructed to be executed is the image forming job or the decoloring job by referring to a parameter value indicating the job type (ACT 001). The job is received by operating the operation panel 104 by a user or receiving a job execution instruction from an external personal computer by the communication section 116.

If the job is the image forming job (ACT 001: Yes), the controller 110 controls the tray drive section 163 to move the movable tray 161 to the discharge port 351 (ACT 002). At the time of moving the tray, the controller 110 detects whether or not the sheet is loaded on each tray based on the signal from the load detection section 170 and the detection signal from the sensor E. If the sheet is already loaded on the tray, the controller 110 moves the tray to a position where the sheet can be discharged on the uppermost surface of the loaded sheet bundle.

The controller 110 controls the post-processing section 165 to align the sheet for each prescribed number of sheets. If a value indicating execution of the sorting processing and any one of the staple processing, the punching processing and the center folding processing is set in the job, the controller 110 executes the post-processing (ACT 003). The controller 110 controls the second conveyance section 171 to discharge the sheet from the discharge port 351 (ACT 004). The discharge destination tray is the movable tray 161 set in ACT 002.

On the other hand, if the job which is instructed to be executed is the decoloring job (ACT 001: No), the controller 110 controls the tray drive section 163 to move the movable tray 162 to the discharge port 351 (ACT 010). The controller 110 aligns the sheets to which the decoloring processing is executed for each prescribed number of sheets with alignment plates for aligning ends of the plurality of the sheets provided in the post-processing section 165 (ACT 011) to discharge the sheet from the discharge port 351 (ACT 004). The discharge destination tray is the movable tray 162 set in ACT 010.

In the present embodiment, the sheet that is processed in a case of the image forming job is discharged to the movable tray 161, and the sheet that is processed in a case of the decoloring job is discharged to the movable tray 162. However, the discharge destination of each job may be reversed. In a case of the decoloring job, after the decoloring processing is executed, only the alignment processing is executed; however, depending on the situation, the post-processing such as the sorting processing, the staple processing, the punching processing and the center folding processing may be executed.

In the present embodiment, even in the decoloring job, the sheet passing through the post-processing section 165 is discharged in an aligned state after the alignment processing is executed. In a case of the decoloring processing, the decoloring processing is executed after the sheet which is the decoloring object is accumulated to an extent in many cases. According to the present embodiment, it is possible to reduce load of the job in which the user aligns the sheet discharged to the movable tray.

Figure 5:
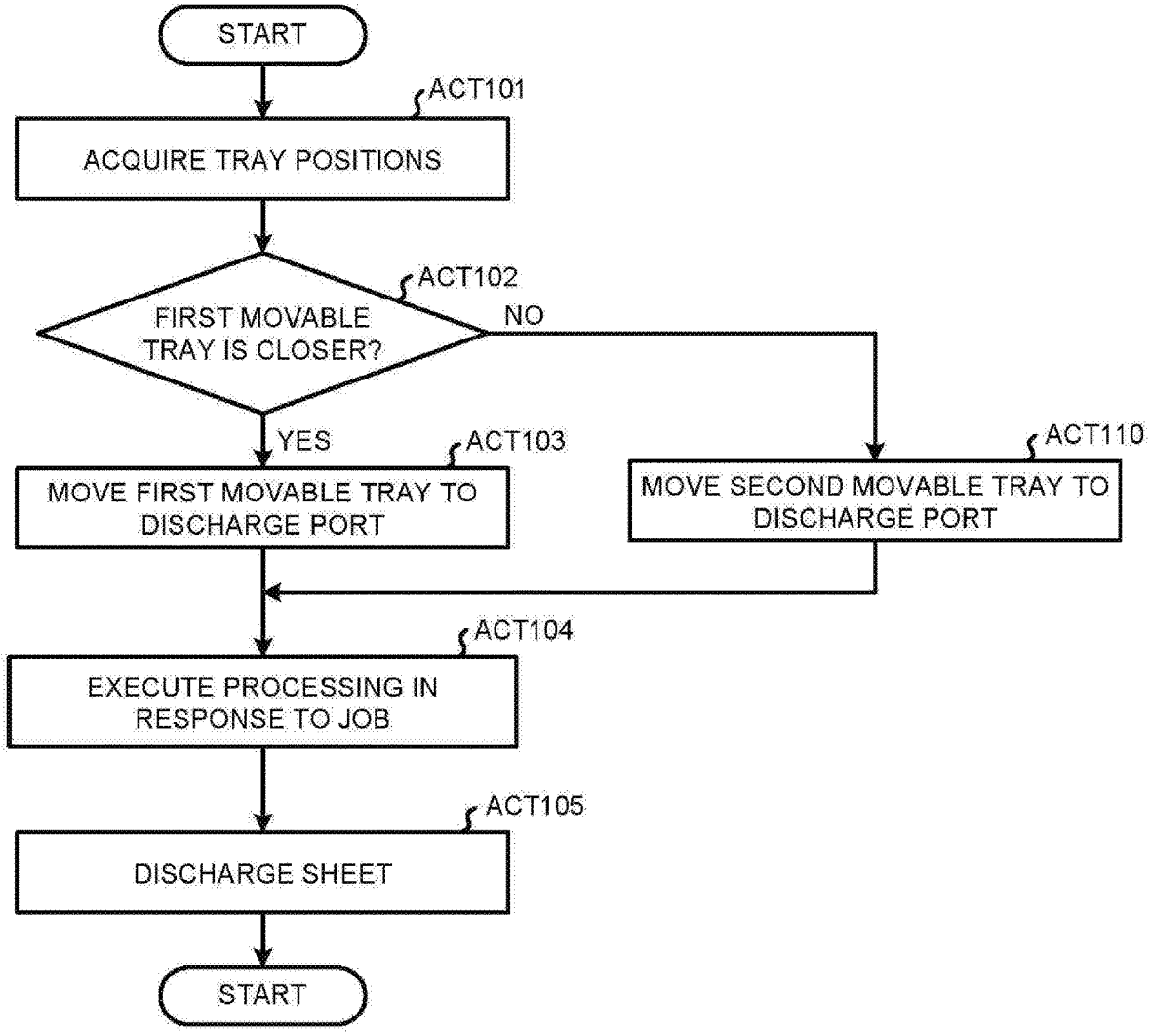
FIG. 5 is a flowchart exemplifying the operation according to the embodiment (discharge destination control according to current positions of trays)

FIG. 5 is a flowchart exemplifying the operation for determining the movable tray positioned nearby the discharge port 351 as the discharge destination tray. The controller 110 inputs a signal detected by the tray position detection section 172 to acquire the tray position (ACT 101). The identification number of each element constituting the light receiving element group 169 is defined according to the position in the vertical direction. The controller 110 specifies the positions of the movable trays 161 and 162 in the vertical direction based on the identification numbers (position information) of the elements receiving the light emitted from the light emitting elements 175 and 176.

The controller 110 determines whether or not the movable tray 161 is closer to the discharge port 351 than the movable tray 162 (ACT 102). If the movable tray 161 is closer (ACT 102: Yes), the controller 110 moves the movable tray 161 to the discharge port 351 (ACT 103). On the other hand, if the movable tray 162 is closer (ACT 102: No), the controller 110 moves the movable tray 162 to the discharge port 351 (ACT 110).

After the movement control of the movable tray in ACT 103 or ACT 110 is executed, the controller 110 executes the processing according to the types of the jobs of the image forming job and the decoloring job (ACT 104).

In the case of the image forming job, after the image forming processing is executed, the alignment processing and any one of the post-processing such as the sorting processing, the staple processing, the punching processing and the center folding processing may be executed as necessary. In the case of the decoloring job, after the decoloring processing is executed, only the alignment processing is executed; however, any one of the post-processing such as the sorting processing, the staple processing, the punching processing and the center folding processing may be executed depending on the situation. The controller 110 discharges the sheet after the post-processing to the tray moved to the discharge port 351 by the processing in ACT 103 or ACT 110 (ACT 105).

Further, only in the processing in FIG. 5, there is a possibility that the sheet to which the image forming processing is executed and the sheet to which the decoloring processing is executed are discharged to the same tray to be mixed. However, the processing in FIG. 5 is effective as a method of determining which tray is the discharge destination in a state (initial state) in which the sheet is not loaded on both trays (this operation is described below with reference to FIG. 7).

Figure 6:
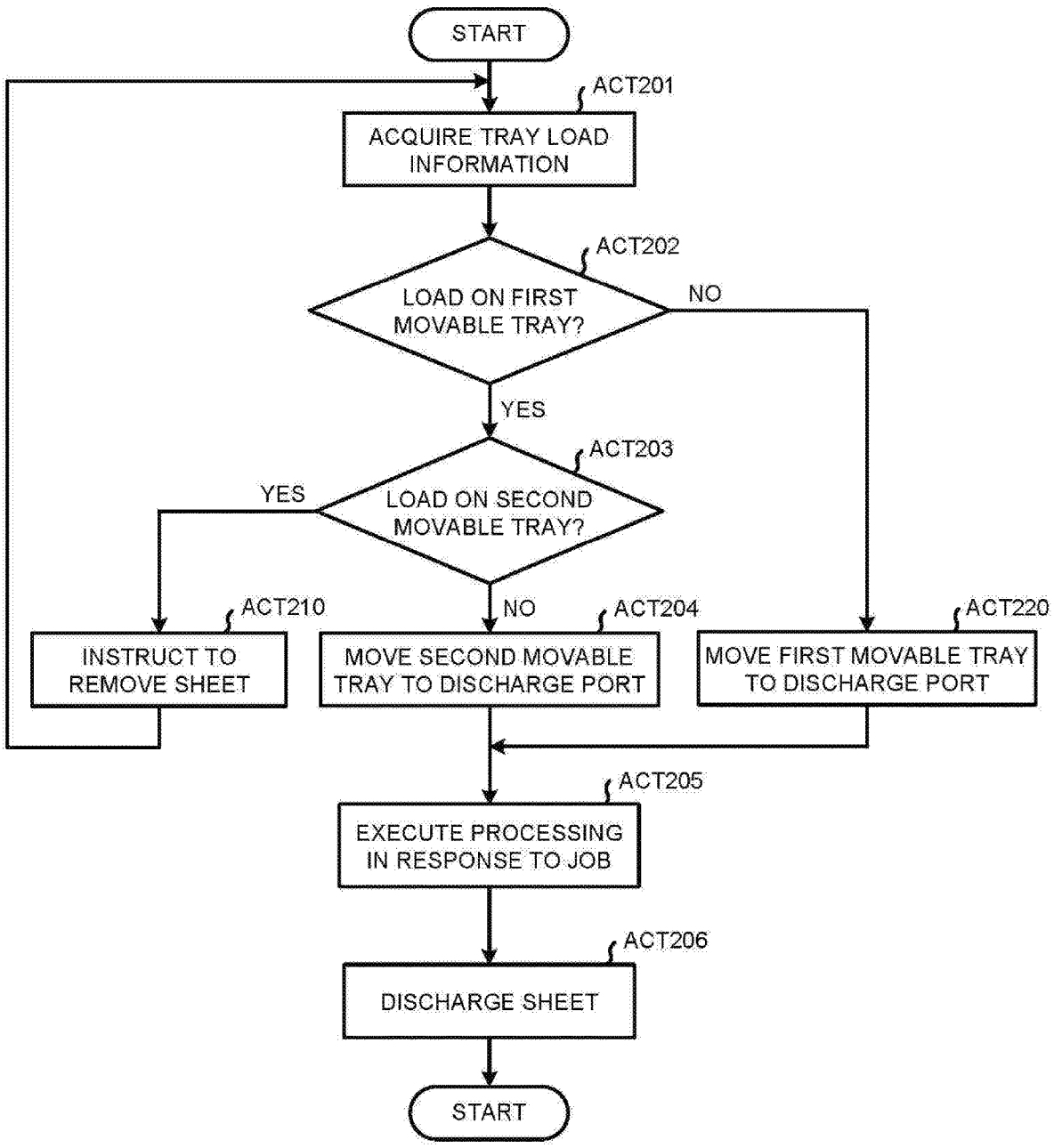
FIG. 6 is a flowchart exemplifying the operation according to the embodiment (discharge destination control according to a tray loading state)

FIG. 6 is a flowchart exemplifying the operation for determining the discharge destination based on whether the sheet is loaded on the movable tray. The controller 110 determines whether there are sheets loaded on the movable trays 161 and 162 (whether there are existing sheets) based on the detection signal from the load detection section 170 (ACT 201). At this time, whether there are sheets is determined for each movable tray. If the sheet is not loaded on the movable tray 161 (ACT 202: No), the controller 110 moves the movable tray 161 to the discharge port 351 (ACT 220). If the sheet is loaded on the movable tray 161 (ACT 202: Yes), and the sheet is not loaded on the movable tray 162 (ACT 203: No), the controller 110 moves the movable tray 162 to the discharge port 351 (ACT 204). If the sheets are loaded on both the movable trays 161 and 162 (ACT 202: Yes and ACT 203: Yes), the controller 110 displays a message for instructing to remove the sheet on the operation panel 104 (ACT 210). Thereafter, if a predetermined operation (for example, press on an OK button displayed at the same time as the message) indicating that the user removes the sheet, the controller 110 returns to the processing in ACT 201.

After the movement control in ACT 204 or ACT 220 is executed, the controller 110 executes the processing according to the job types of the image forming job and the decoloring job (ACT 205). The operation in ACT 205 is the same as the operation in ACT 104 in FIG. 5. Then, the controller 110 discharges the sheet after the post-processing to the tray moved to the discharge port 351 (ACT 206).

Figure 7:
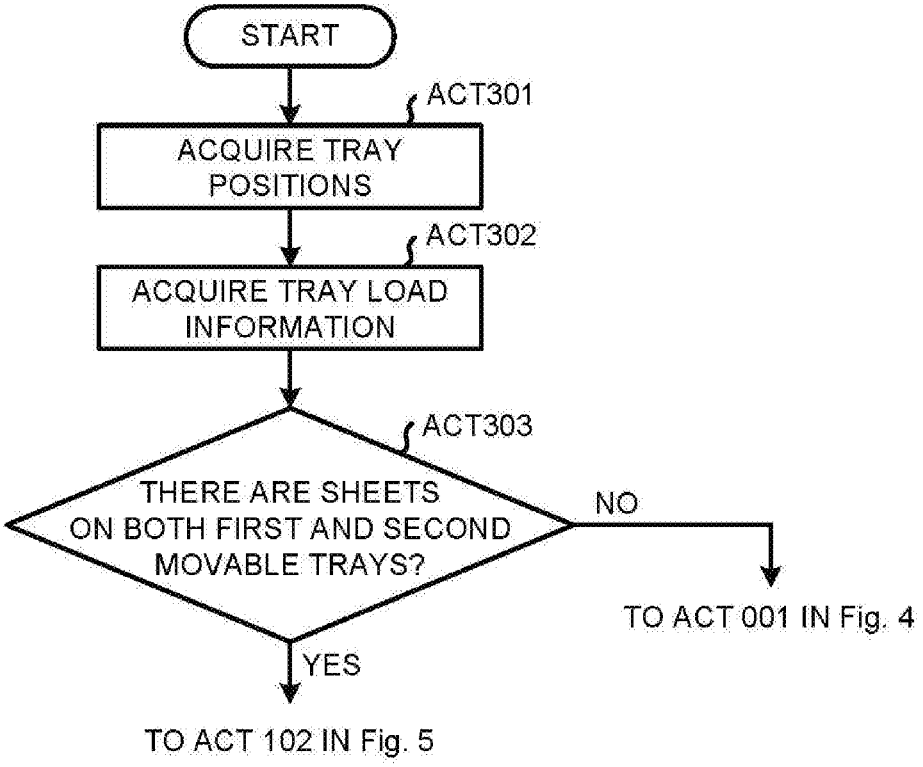
FIG. 7 is a flowchart exemplifying the operation according to the embodiment (combined control according to the job type and the tray positions).

FIG. 7 is a flowchart illustrating a case of complexly executing the operations in the above diagrams. The controller 110 specifies the positions of the movable trays 161 and 162 in the vertical direction (ACT 301) to acquire information indicating whether or not the sheets are loaded on the trays (ACT 302). The operation is the same as that in ACT 101 in FIG. 5 and that in ACT 201 in FIG. 6. The controller 110 determines whether or not there are sheets on both the movable trays 161 and 162 (all trays) based on the result obtained in ACT 302 (ACT 303).

If the sheets are loaded on both trays (ACT 303: Yes), the controller 110 executes the operations subsequent to ACT 102 in FIG. 5 in the same way as stated above. In other words, the operations of discharging the sheet to the tray nearby the discharge port 351 are executed. After the operations subsequent to ACT 102 in FIG. 5 are executed, the controller 110 stores the type of the executed job and the discharge destination tray of the job in the storage section 182 in an associated manner. If the current execution job is the image forming job and the sheet is discharged to the movable tray 161, the controller 110 stores the image forming job and the movable tray 161 in an associated manner. The storage operation is executed so that the controller 110 carries out control to discharge the sheet to the movable tray 161 if the job is the image forming job. Further the storage operation is executed so that controller 110 carries out control to discharge the sheet to the movable tray 162 if the job is the decoloring job at the time of executing the following jobs.

In ACT 303, if the sheet is not loaded on any one tray or both trays (ACT 303: No), the controller 110 executes the operations subsequent to in ACT 001 in FIG. 4. In other words, the operations of determining the discharge destination according to the job type are executed. The discharge destination tray is determined according to the association stored in the storage section 182. For example, if the image forming job and the movable tray 161 are associated with each other as stated above, the operations shown in FIG. 4 are executed in the same way as stated above. If the decoloring job is associated with the movable tray 162, the processing is executed according to the operations in FIG. 4 except that the discharge destination tray is reversed from that determined in FIG. 4.

Further, in FIG. 7, in a case in which the determination in ACT 303 is negative, the operations subsequent to ACT 202 in FIG. 6 may be executed.

The above operation may be operation of each unit constituting the image forming system by taking the controller 196 of the post-processing device 160 as the subject. In this case, by using the processor 191, the storage section 192 and the control program 193, instead of the controller 110 of the image processing apparatus 101, the above operation control is executed. In this case, the image processing system of the forgoing embodiment may be an invention relating to the post-processing device.

The above operation may control the operation of each unit constituting the image processing system by cooperation of the controller 110 of the image processing apparatus 101 and the controller 196 of the post-processing device 160. In this case, the control of the operation of each unit in the image processing apparatus 101 is executed by the processor 181 the storage section 182 and the control program 183 of the controller 110. The control of the operation of each unit in the post-processing device 160 is executed by the processor 191, the storage section 192 and the control program 193.

Thus, the image processing system according to the present invention is not limited to having a constitution in which the post-processing device is connected to the image processing system, and is also applicable to post-processing device alone and the image forming apparatus having the post-processing function.

In the above embodiment, there are two movable trays as the discharge destination; however, it is applicable that there are three or more movable trays. The unit for receiving the job such as the communication section 116 and the operation panel 104 is set as a reception section.

As described in detail above, according to the technology described in this specification, it is possible to suppress mixing of the sheet to which the image forming processing is executed and the sheet to which the decoloring processing is executed on the same tray.

The decoloring processing of the image in the present embodiment may be carried out with the following method besides the decoloring processing by heating. For example, the decoloring processing may be executed by executing a processing for emitting the light to the image on the sheet or coating chemical solvent and peeling the image.

The present invention can be implemented in a variety of other forms without departing from the spirit or main characteristics of the invention. Therefore, the above embodiments are merely examples in all respects but not as limitations. The scope of the present invention is illustrated by the scope of the accompanying claims and is not limited to this specification. Furthermore, various improvements, substitutions and reforms belonging to the equivalent scope of the scope of the claims all fall within the scope of the present invention.

What is claimed is:

1. An image processing system, comprising:

a discharge section configured to discharge a sheet to which an image forming processing or a decoloring processing is executed;

a first tray configured to load the sheet discharged from the discharge section;

a second tray, arranged below the first tray, configured to load the sheet discharged from the discharge section;

a heating device that generates heat to facilitate a fixing process and decoloring processing; and a controller configured to direct discharge of a sheet to which the image forming processing is executed to one of the first tray and the second tray and to direct discharge of a sheet to which decoloring processing is executed to the other tray according to a type of a job received by a reception section, and wherein the controller is also configured to control the heating device to generate different temperatures for the fixing process and the decoloring processing.

2. The image processing system according to claim 1, further comprising:

a post-processing section configured to execute a post-processing to the sheet to which the image forming processing is executed or the sheet to which the decoloring processing is executed, wherein the controller is configured to direct discharge of the sheet to which the image forming processing is executed or the sheet to which the decoloring processing is executed to the first tray or the second tray via the post-processing section.

3. The image processing system according to claim 2, wherein the post-processing section is configured to execute an alignment processing if the received job is a decoloring job and executes the alignment processing and a post-processing defined in the job if the received job is an image forming job.

4. The image processing system according to claim 1, further comprising:

a tray position detection section configured to detect positions of the first tray and the second tray, wherein the controller is configured to set a discharge destination of the sheet to the first tray or the second tray according to positions detected by the tray position detection section.

5. The image processing system according to claim 1, wherein the controller directs discharge of the sheet to a tray close to the position of the discharge section between the first tray and the second tray.

6. The image processing system according to claim 2, wherein the post-processing section is configured to execute one or more of an alignment processing for stacking a plurality of sheets, a staple processing for executing a binding processing, a punching process for executing a processing of punching a hole on a sheet, a center folding processing for folding a center part of the plurality of the sheets in half, and a sorting processing.

7. The image processing system according to claim 1, further comprising:

an image forming section is configured to form an image on a sheet.

8. The image processing system according to claim 1, further comprising:

a sheet detection sensor configured to detect whether or not the sheet is on the first tray.

9. The image processing system according to claim 1, further comprising:

a sheet detection sensor configured to detect whether or not the sheet is on the second tray.

10. The image processing system according to claim 2, wherein the type of job comprises an image forming job or a decoloring job.

11. An image processing method, comprising:

discharging a sheet to which an image forming processing or a decoloring processing is executed;

providing a first tray and a second tray arranged below the first tray, the first tray and the second tray vertically load the sheet discharged;

heating, by a heating device, the sheet to facilitate a fixing process and decoloring processing;

directing discharge of a sheet to which the image forming processing is executed to one of the first tray and the second tray and discharge of a sheet to which a decoloring processing is executed to the other tray according to a type of a job received; and controlling the heating device to generate different temperatures for the fixing process and the decoloring processing.

12. The image processing method according to claim 11, further comprising:

executing a post-processing to the sheet to which the image forming processing is executed or the sheet to which the decoloring processing is executed; and directing discharge of the sheet to which the image forming processing is executed or the sheet to which the decoloring processing is executed to the first tray or the second tray via a post-processing section.

13. The image processing method according to claim 12, further comprising:

executing an alignment processing if the received job is a decoloring job and executing the alignment processing and a post-processing defined in the job if the received job is an image forming job.

14. The image processing method according to claim 11, further comprising:

detecting positions of the first tray and the second tray; and setting a discharge destination of the sheet to the first tray or the second tray according to positions detected.

15. The image processing method according to claim 11, further comprising:

directing discharge of the sheet to a movable tray close to the position of the discharge section between the first tray and the second tray.

16. The image processing method according to claim 12, further comprising:

executing one or more of an alignment processing, a staple processing, a punching process, a center folding processing, and a sorting processing.

17. The image processing method according to claim 11, further comprising:

forming an image on a sheet.

18. The image processing method according to claim 11, further comprising:

detecting whether or not the sheet is on the first tray.

19. The image processing method according to claim 11, further comprising:

detecting whether or not the sheet is on the second tray.

20. The image processing method according to claim 12, wherein the type of job comprises an image forming job or a decoloring job.

* * * * *